US009903077B2

(12) United States Patent
Rio

(10) Patent No.: US 9,903,077 B2
(45) Date of Patent: Feb. 27, 2018

(54) SYSTEM AND METHOD FOR PERFORMING A COMPACTION OPERATION

(71) Applicant: Caterpillar Paving Products Inc., Brooklyn Park, MN (US)

(72) Inventor: Federico Rio, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 36 days.

(21) Appl. No.: 15/089,890

(22) Filed: Apr. 4, 2016

(65) Prior Publication Data

US 2017/0284036 A1 Oct. 5, 2017

(51) Int. Cl.
*G06F 7/70* (2006.01)
*E01C 19/28* (2006.01)

(52) U.S. Cl.
CPC ..... *E01C 19/288* (2013.01); *E01C 19/282* (2013.01)

(58) Field of Classification Search
USPC ..... 701/50
See application file for complete search history.

(56) References Cited

U.S. PATENT DOCUMENTS 4,546,425 A 10/1985 Breitholtz
5,471,391 A * 11/1995 Gudat ..... E01C 19/004 340/995.1
6,122,601 A 9/2000 Swanson et al.
6,236,923 B1 * 5/2001 Corcoran ..... B60C 23/00 340/442
7,908,084 B2 3/2011 Anderegg et al.
9,039,319 B2 5/2015 Oetken
2003/0079559 A1 * 5/2003 Potts ..... B06B 1/166 74/87
2007/0129869 A1 * 6/2007 Gudat ..... G05D 1/0297 701/50
2007/0150147 A1 6/2007 Rasmussen et al.
2011/0158745 A1 * 6/2011 Oetken ..... E01C 19/286 404/72
2012/0173202 A1 * 7/2012 Julian ..... B09B 1/00 703/1
2012/0310532 A1 * 12/2012 Snoeck ..... G06Q 10/06 701/482
2013/0136539 A1 * 5/2013 Aardema ..... G01K 1/024 404/75
2015/0003911 A1 * 1/2015 Oetken ..... E01C 19/288 404/75
2015/0268218 A1 * 9/2015 Troxler ..... G01S 13/0209 342/21
2016/0076205 A1 * 3/2016 Corcoran ..... E02D 3/026 73/784

* cited by examiner

*Primary Examiner* — Tyler D Paige

(57) ABSTRACT

A system for compacting a work area is described. The system includes a compactor having a variable vibratory mechanism for providing a compaction effort to the work area. The system further includes a location sensor to generate a location data for the compactor. The system further includes a controller in communication with the location sensor and the variable vibratory mechanism. The controller is configured to determine a pass count for the work area based on the location data. The controller is further configured to determine a target compaction effort for the work area based on the pass count. The controller is further configured to modify the compaction effort to the target compaction effort.

20 Claims, 4 Drawing Sheets

SYSTEM AND METHOD FOR PERFORMING A COMPACTION OPERATION

TECHNICAL FIELD

The present disclosure relates generally to a system and a method for performing a compaction operation, and in particular, to a system and a method for performing a compaction operation by a compactor.

BACKGROUND

Preparation of roadways, building sites, embankments and other surfaces often requires compaction to produce desired material properties. To facilitate material compaction, compactors (also referred to as compacting machines) are often employed to compact soil, gravel, asphalt, and other materials. Compactors may include, for example, a rotating drum having one or more rotatable drum assemblies which roll over the material to be compacted. The rotating drum may be a static roller system in which the weight of the compactor and the drum produces the compaction. Some compactors also include a vibratory mechanism which provides a compaction effort to enhance the compaction process, generally, based on the characteristics of the material to be compacted and stage of compaction operation.

Compaction operation generally includes driving one or more compactors over a work area multiple times until it is compacted to target. Material being compacted is normally initially soft and of low density before compaction begins. After each pass, the level of compaction of the material incrementally increases and therefore, the subsequent passes should be performed with a different compaction effort. Usually, this effect is achieved by using two or more distinct compactors in series with each one of the compactors set at a different compaction effort.

Current approaches for deciding and changing the setting of the vibratory mechanism rely mostly upon operator judgment and perception, which require substantial operator training and preparation time. These approaches have the potential for human error and tend to be inconsistent in quality. Accordingly, when constructing long roads and highways, a significant number of pavement and rolling deficiencies appear. These deficiencies tend to increase construction time and cost.

U.S. Pat. No. 6,236,923 (hereinafter referred to as "the '923 patent") describes a method and apparatus for controlling the inflation pressure on a pneumatic compactor. The '923 patent describes that the method and apparatus includes means for dynamically determining a level of density of a material to be compacted, a control system for determining a desired inflation pressure as a function of the density, and an inflation pressure system for adjusting the inflation pressure in response to the desired inflation pressure. In one example, the '923 patent describes that the control system determines the level of density of material as a function of the number of passes of the pneumatic compactor over a compaction area.

SUMMARY

In one aspect of the present disclosure, a system for compacting a work area is provided. The system includes a compactor having a variable vibratory mechanism for providing a compaction effort to the work area. The system further includes a location sensor to generate a location data for the compactor. The system further includes a controller in communication with the location sensor and the variable vibratory mechanism. The controller is configured to determine a pass count for the work area based on the location data. The controller is further configured to determine a target compaction effort for the work area based on the pass count. The controller is further configured to modify the compaction effort to the target compaction effort.

In another aspect of the present disclosure, a method of operating a compactor providing a compaction effort over a work area is provided. The method includes generating a location data for the compactor. The method further includes determining a pass count for the work area based on the location data. The method further includes determining a target compaction effort for the work area based on the pass count. The method further includes modifying the compaction effort to the target compaction effort.

In yet another aspect of the present disclosure, a compactor is provided. The compactor includes a frame and a compacting drum operably connected to the frame. The compactor also includes a variable vibratory mechanism coupled to the compacting drum. The variable vibratory mechanism is configured to provide a compaction effort to a work area. The compactor further includes a control system. The control system includes a location sensor configured to generate a location data for the compactor. The control system further includes a controller in communication with the location sensor and the variable vibratory mechanism. The controller is configured to receive the location data. The controller is further configured to determine a pass count for work area based on the location data. The controller is further configured to determine a target compaction effort for the work area based on the pass count. The controller is further configured to modify the compaction effort to the target compaction effort.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
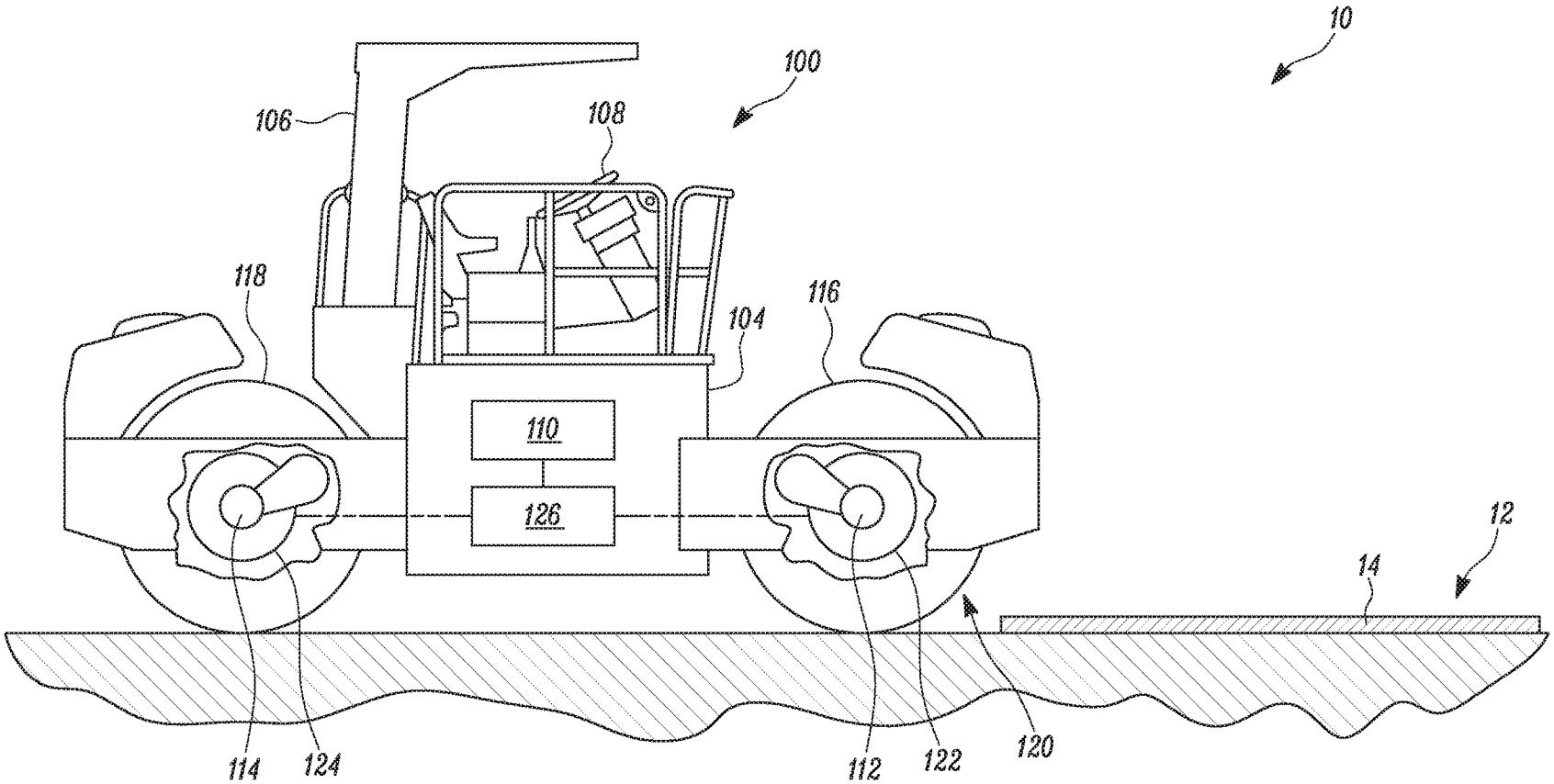
FIG. 1 illustrates a planar diagrammatic view of a compactor, in accordance with an embodiment of the present disclosure.

FIG. 1 is an exemplary representation of a system 10, in accordance with an embodiment of the present disclosure. In FIG. 1, a diagrammatic planar view of a compactor 100 (also referred to as compacting machine) is shown. The compactor 100 may refer to any type of machine for compacting a paving material, such as, for example, soil, sand, gravel, loose bedrock, asphalt, recycled concrete, bituminous mixtures, or any other compactable material. For example, the compactor 100 may include a rolling compactor, a plate compactor, a self-propelled compactor, a compactor towed behind a paving machine, or any compaction device known in the art. In the illustration of FIG. 1, the compactor 100 is shown as an asphalt compactor. However, those of skill in the art will recognize that any type of compactor may be used, such as a soil compactor, landfill compactor, utility compactor, etc.

FIG. 1 also illustrates a representation of a work area 12, shown in the form of a strip, layered with a paving material 14 to be compacted. The work area 12 may be a part of a larger worksite (shown in FIG. 4) in which multiple compactors 100 may be operating to complete the compaction operation. That is, the larger worksite may be divided into multiple work areas 12. The work areas 12 may be of any size, but are usually sized to allow accurate measurement of the compaction state of the entirety of the work area 12 and display of the compaction state of work areas 12 to the operator of the compactor 100. A work area 12 sized too large would have multiple compaction states, whereas a work area 12 too small would complicate compaction of the worksite since the operator would not be able to control the compaction state of a specific work area 12 without affecting surrounding work areas 12. In one example, each work area 12 may be an area ⅓ meter by ⅓ meter. The work areas 12 may be displayed to operator of the compactor 100 as a map (shown in FIG. 4), indicating a pass count state of the work area 12, what work areas 12 are at the desired compaction state, and which work areas 12 continue to need compaction effort applied to reach the desired compaction state.

The compactor 100 may include a frame 104, and an operator cab 106 supported on the frame 104 and having an operator input device such as a steering wheel 108 or similar control device for controlling a travel direction of the compactor 100. The compactor 100 may further include an engine 110. The engine 110 may by supported on the frame 104 and may be configured to provide mechanical and/or electrical power to the compactor 100. The engine 110 may include a variety of suitable engine types. For example, the engine 110 may include an internal combustion engine, an electric generator, a fluid pump, or any other suitable device configured to propel the compactor 100. In one example, the engine 110 may be configured to provide power to components of the compactor 100, such as a first motor 112, a second motor 114, and other systems of the compactor 100. The motors 112, 114 may be operably coupled to the engine 110 via electrical wires, fluid conduits, or any other suitable connection. For example, where the engine 110 provides electrical power, the motors 112, 114 may be electric motors. Alternatively, where the engine 110 provides hydraulic power, the motors 112, 114 may be fluid motors.

The compactor 100 may include various components to facilitate the compaction operation, and further prevents de-compaction and crushing of the paving material 14 during the compaction operation. The compactor 100 may include one or more compacting elements, such as a first compacting drum 116 and a second compacting drum 118. The first compacting drum 116 and the second compacting drum 118 may be rotatably mounted on the frame 104. The first compacting drum 116 and the second compacting drum 118 may be operatively connected to the first motor 112 and the second motor 114, respectively, such that the first motor 112 may drive the first compacting drum 116 and the second motor 114 may drive the second compacting drum 118.

In an embodiment, the compactor 100 may further include a variable vibratory mechanism 120. The variable vibratory mechanism 120 may be disposed in connection with the compacting drums 116, 118. Specifically, the variable vibratory mechanism 120 may include a first vibratory mechanism 122 and a second vibratory mechanism 124 coupled to the first compacting drum 116 and the second compacting drum 118, respectively. In one example, the first vibratory mechanism 122 and the second vibratory mechanism 124 may also be operatively connected to the first motor 112 and the second motor 114, respectively. The variable vibratory mechanism 120 may be configured to provide a compaction effort to the work area 12. In particular, the variable vibratory mechanism 120 may be configured to make the compacting drums 116, 118 vibrate with a predetermined frequency and amplitude depending on the requirements of the compaction operation. It may be contemplated that the compaction effort is directly proportional to the amplitude of vibration, and usually inversely proportional to the frequency of vibration. Therefore, an increase in compaction effort demands an increase in amplitude of vibration, and vice-versa.

It may be understood that the term "variable vibratory mechanism" may not be limited to mechanisms providing compaction effort using only vibrations of the compacting elements, but may also apply to other type of mechanisms which provide compaction effort using, for example, oscillatory or reciprocating movement of the compacting elements. In the subsequent paragraphs, the functioning of the variable vibratory mechanism 120 has been described in terms of the first vibratory mechanism 122. However, it may be contemplated that the same description applies to the second vibratory mechanism 124 as well. In some examples, the first vibratory mechanism 122 may include one or more weights (not shown) disposed inside an interior volume of the first compacting drum 116. The one or more weights may be disposed at a position off-center from a common axis (not shown) around which the first compacting drum 116 rotates. That is, the weights are eccentrically positioned with respect to the common axis and are typically movable with respect to each other about the common axis to produce varying degrees of imbalance during rotation of the weights. As the first compacting drum 116 rotates, the off-center or eccentric positions of the weights induce oscillatory or vibrational forces to the first compacting drum 116, which in turn are imparted to the work area 12 being compacted.

The amplitude of the vibrations produced by such an arrangement of eccentric rotating weights may be varied by changing the positioning of the eccentric weights with respect to each other about their common axis. This varies the average distribution of mass, that is, the centroid, with respect to the common axis of the weights. It may be contemplated that the amplitude in such an arrangement increases as the centroid moves away from the common axis of the weights and decreases toward zero as the centroid moves toward the common axis. Further, varying the rotational speed of the weights about their common axis may change the frequency of the vibrations produced by such an arrangement of rotating eccentric weights. In some examples, the eccentrically positioned weights are arranged to rotate inside the first compacting drum 116 independently of its rotation so as to have more control over changing the amplitude and/or frequency of the vibration of the first compacting drum 116 during the compaction operation.

Both, amplitude and frequency of vibration are typically controlled to vary the degree of compaction. By altering the distance of the eccentric weights from the common axis in variable vibratory mechanism 120, the amplitude portion of the compaction effort is modified. By altering the speed of rotation of the eccentric weights about the common axis, the frequency portion of the compaction effort is modified. Additionally, both the amplitude portion and the frequency portion of the compaction effort of the variable vibratory mechanism 120 may be modified by changing both, the distance of the eccentric weights and the speed of rotation of the eccentric weights with respect to the common axis, at the same time. The present disclosure is not limited to such arrangement of eccentric weights, as described above. In some examples, other types of variable vibratory mechanism that modifies the compaction effort of the compactor 100 may be employed without departing from the scope of the present disclosure.

Further, it may be understood that the compactor 100 may include fewer or additional components designed to compact the paving material 14, and still achieve the desired compaction effort over the work area 12. For example, the compactor 100 may include only one compacting element, such as the first compacting drum 116 and includes tires in place of the second compacting drum 118. Further, the compacting drums 116, 118 may include various surface configurations to facilitate compaction of the paving material 14, such as the surface of the compacting drums 116, 118 may be generally smooth and/or include a studded surface.

Figure 2:
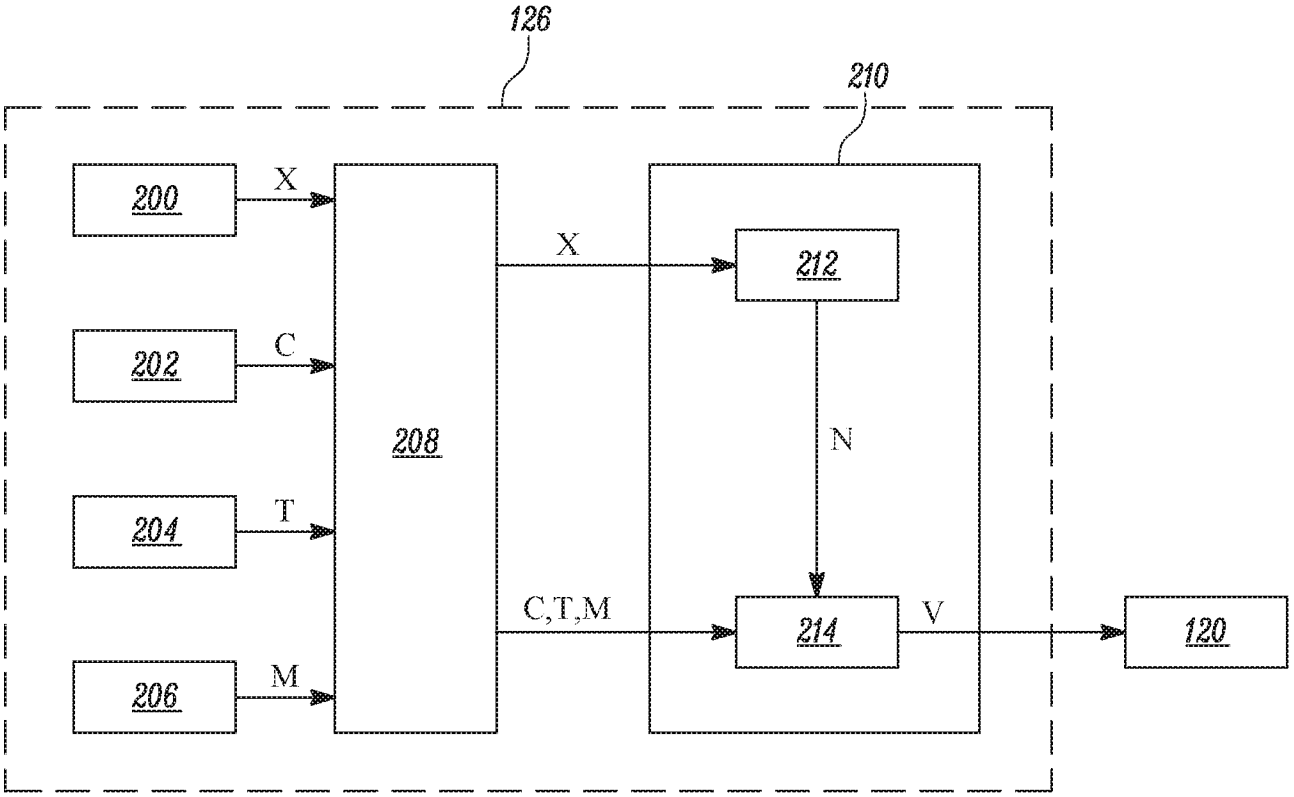
FIG. 2 illustrates a schematic view of a control system in connection with a variable vibratory mechanism of the compactor of FIG. 1, in accordance with an embodiment of the present disclosure.

As schematically depicted in FIG. 1, the compactor 100 may include a control system 126 for controlling the compaction operation over the work area 12. In another embodiment, the control system 126 may be located remote of the compactor 100, being a part of the system 10. The terms "control system 126" and "system 10" have been interchangeably used in view of such embodiment. The control system 126 controls the power supplied from the engine 110 to the motors 112, 114, and thus controls the compaction effort produced by the variable vibratory mechanism 120. FIG. 2 illustrates an exemplary embodiment of the control system 126. The blocks, as shown in FIG. 2, represent various components of the control system 126, and further various lines represent the signal lines configured for data communication between the various components of the control system 126. The directional arrows represent the transmission of data from one component to other component of the control system 126.

In an embodiment, the control system 126 may include a location sensor 200. The location sensor 200 may be configured to determine the location of the compactor 100, specifically, with respect to the work area 12. In one example, the location sensor 200 may be disposed on the compactor 100. The location sensor 200 may include one or more of a Global Positioning System (GPS), a Global Navigation Satellite System (GNSS), a laser-based positioning system, a trilateration/triangulation based system using cellular or Wi-Fi networks, a pseudo-satellite, a ranging radio, and a perception sensor. In other examples, the location sensor 200 may be an external component configured to track the movement of the compactor 100 using radar or similar tracking systems. However, other location determining systems, for example, dead reckoning or the like, could be used as well. The location sensor 200 may be configured to generate a location data 'X' indicative of the movement of the compactor 100.

In some examples, the control system 126 may also include a compaction sensor 202. The compaction sensor 202 may be located on one or both of the compacting drums 116, 118 of the compactor 100. The compaction sensor 202 may be configured to generate compaction data 'C' corresponding to the density of the paving material 14 being compacted as the compactor 100 traverses the work area 12. The compaction sensor 202 may be of a type known in the art, and include one or more of accelerometers, ground penetrating radar sensors, sonic sensors, gage wheels, nuclear density sensors, vibratory sensors, and the like. Alternatively, the compaction sensor 202 may use indirect technologies, for example, machine power usage indicators, temperature indicators, motion resistance indicators, or any combination of these technologies for the purpose.

In some examples, the control system 126 may also include a temperature sensor 204 configured to generate a temperature data 'T' of the work area 12. In one example, the temperature sensor 204 may be a non-contact type of temperature sensor capable of remotely sensing the temperature of the paving material 14 layered over the work area 12, without the need for any portion of the temperature sensor 204 to make physical contact with the work area 12. For example, the temperature sensor 204 may be one of a thermal imager or a thermal scanner operating in "line-scan" mode. In other examples, the temperature sensor 204 may be an appropriate contact type of temperature sensor, such as, for example, a thermocouple with a sensing junction placed on one of the compacting drums 116, 118.

Further, in some examples, the control system 126 may also include a moisture sensor 206 configured to generate a moisture data 'M' of the work area 12. In one example, the moisture sensor 206 may be a microwave sensor configured to scan moisture content of the paving material 14 without contacting it, as the compactor 100 traverses over the work area 12. In other examples, the moisture sensor 206 may measure the moisture content indirectly by using some other property of the paving material 14, such as electrical resistance, dielectric constant, or interaction with neutrons, as a proxy for the moisture content.

In one example, the control system 126 may also include a sensor hub 208 disposed in signal communication with various sensors 200, 202, 204, 206 associated with the compactor 100. The sensor hub 208 may be configured to collect the data from the sensors 200, 202, 204, 206. In particular, the sensor hub 208 may collect the location data 'X' from the location sensor 200, the compaction data 'C' from the compaction sensor 202, the temperature data 'T' from the temperature sensor 204 and the moisture data 'M' from the moisture sensor 206. The sensor hub 208 may act as a communication channel between the sensors 200, 202, 204, 206 and other components of the control system 126. It may be contemplated that the sensor hub 208 may utilize any known communication standard, such as Wi-Fi, Bluetooth, infrared, or any combination thereof.

In an embodiment, the control system 126 may further include a controller 210. The controller 210 may be a logic unit using one or more integrated circuits, microchips, microcontrollers, microprocessors, all or part of a central processing unit (CPU), graphics processing unit (GPU), digital signal processor (DSP), field programmable gate array (FPGA), or other circuits suitable for executing instructions or performing logic operations. It will be appreciated that other peripheral circuitry such as buffers, latches, switches and so on may be implemented within the controller 210 or separately as desired. Various other circuits may also be associated with the controller 210, such as power supply circuitry, signal conditioning circuitry, solenoid driver circuitry, and other types of circuitry.

Further it may be understood that the controller 210 may be associated with a software product stored on a non-transitory computer readable memory (not shown) and comprising data and computer implementable instructions, which when executed by the controller 210 cause the compactor 100 to perform compacting operation. The non-transitory computer readable medium may include a memory, such as RAM, ROM, flash memory, a hard drive, etc. The computer readable memory may also be configured to store electronic data associated with operation of the compactor 100.

Information from the sensor hub 208, including the location data 'X', the compaction data 'C', the temperature data 'T' and the moisture data 'M' may be transmitted to the controller 210, via wired or wireless communication systems. In one example, the location data 'X', the compaction data 'C', the temperature data 'T' and the moisture data 'M' may be temporarily stored in the memory of the controller 210. In one example, the controller 210 may include a first module 212 and a second module 214, and configured to process the received data to control compaction operation. It may be contemplated that the first module 212 and the second module 214 are algorithms configured to process data based on predefined instructions.

In an embodiment, the first module 212 may configure the controller 210 to process the location data 'X' to determine a pass count 'N' indicative of the number of passes made by the compactor 100 over the work area 12. The algorithms to determine the number of passes using the location data are well known in the art and have not been described herein for the brevity of the disclosure. It may be contemplated by a person skilled in the art that each pass made by the compactor 100 over the work area 12 is correlated to a level of density of the material in the work area 12, and as the number of passes increases, the density of the paving material 14 changes by a predetermined amount. Therefore, there is a need to change the compaction effort for a subsequent pass of the compactor 100, in view of the change in the density of the paving material 14 with the previous pass. The second module 214 may configure the controller 210 to determine a target compaction effort 'V' for the subsequent pass of the compactor 100 over the work area 12 based on the determined pass count 'N'.

The target compaction effort 'V' corresponds to at least one of an amplitude value and a frequency value for the variable vibratory mechanism 120 of the compactor 100. In one example, the controller 210 may receive real time information about the location data 'X' during the compaction operation. Further, the controller 210 determines the pass count 'N' in real time, and dynamically determines the target compaction effort 'V' for the compaction operation.

In some examples, the second module 214 may also configure the controller 210 to adjust the target compaction effort 'V' specifically in response to the change in the density of the paving material 14 with each pass of the compactor 100 over the work area 12. That is, the controller 210 adjusts the target compaction effort 'V' based on the compaction data 'C', received from the sensor hub 208. In other examples, the controller 210 may also consider, in part, the temperature data 'T' and the moisture data 'M' in order to adjust the target compaction effort 'V' for each subsequent pass of the compactor 100 over the work area 12.

In an embodiment, the controller 210 may transmit the target compaction effort 'V' to the variable vibratory mechanism 120. Further, the variable vibratory mechanism 120 adjusts at least one of the amplitude and the frequency of vibration for one or both of the first vibratory mechanism 122 and the second vibratory mechanism 124 to the amplitude value and the frequency value corresponding to the target compaction effort 'V'. For this purpose, the first vibratory mechanism 122 and the second vibratory mechanism 124 adjusts the position and/or the speed of rotation of the eccentric weights disposed inside the compacting drums 116, 118, as discussed above. Thus, in one example, the compactor 100 may traverse over the work area 12 with first amplitude and/or first frequency for one pass or set of passes, and second amplitude and/or second frequency value for a subsequent pass or subsequent set of passes, and so on.

Figure 3:
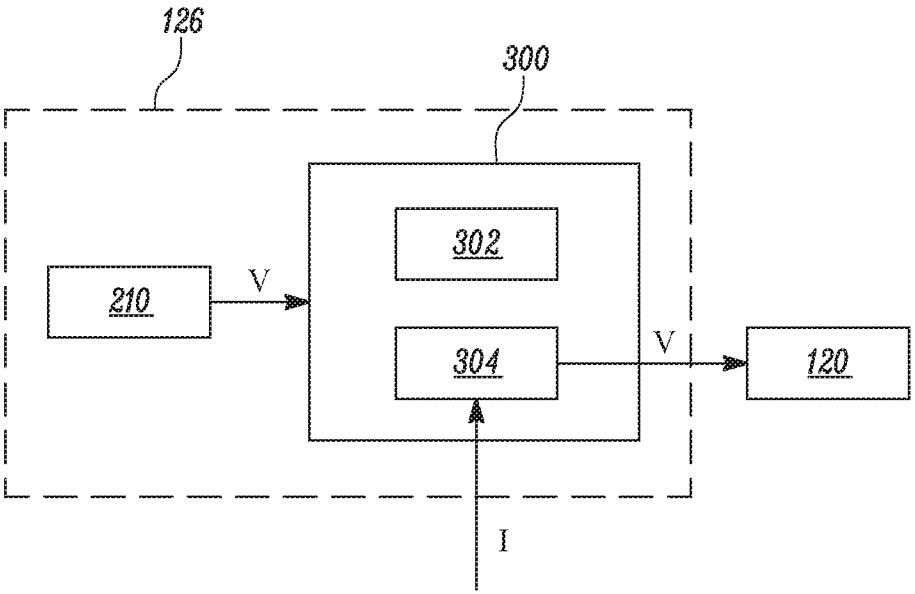
FIG. 3 illustrates a schematic view of a control system in connection with a variable vibratory mechanism of the compactor of FIG. 1, in accordance with another embodiment of the present disclosure.

In an embodiment, as illustrated in FIG. 3, the control system 126 may also include an operator control device 300 disposed in signal communication with the controller 210. It may be seen that some of the components of the control system 126, such as sensors 200, 202, 204, 206 and the sensor hub 208 have not been shown for simplification. The operator control device 300 may include a display device 302 configured to receive the data corresponding to the target compaction effort 'V' from the controller 210 and notify an operator of the compactor 100 about the amplitude value and the frequency value, in numerical or some other forms, corresponding to the target compaction effort 'V'. Further, the operator control device 300 may include an input device 304 configured to receive an input 'I' from an operator of the compactor 100. In such embodiments, the control system 126 may modify the compaction effort to the target compaction effort 'V' in response to receiving the input 'I', that is, the compaction effort is modified only after the operator accepts the target compaction effort 'V'. It may be contemplated that the display device 302 and the input device 304 may be a single unit in the form of a touch sensitive display screen or the like.

Figure 4:
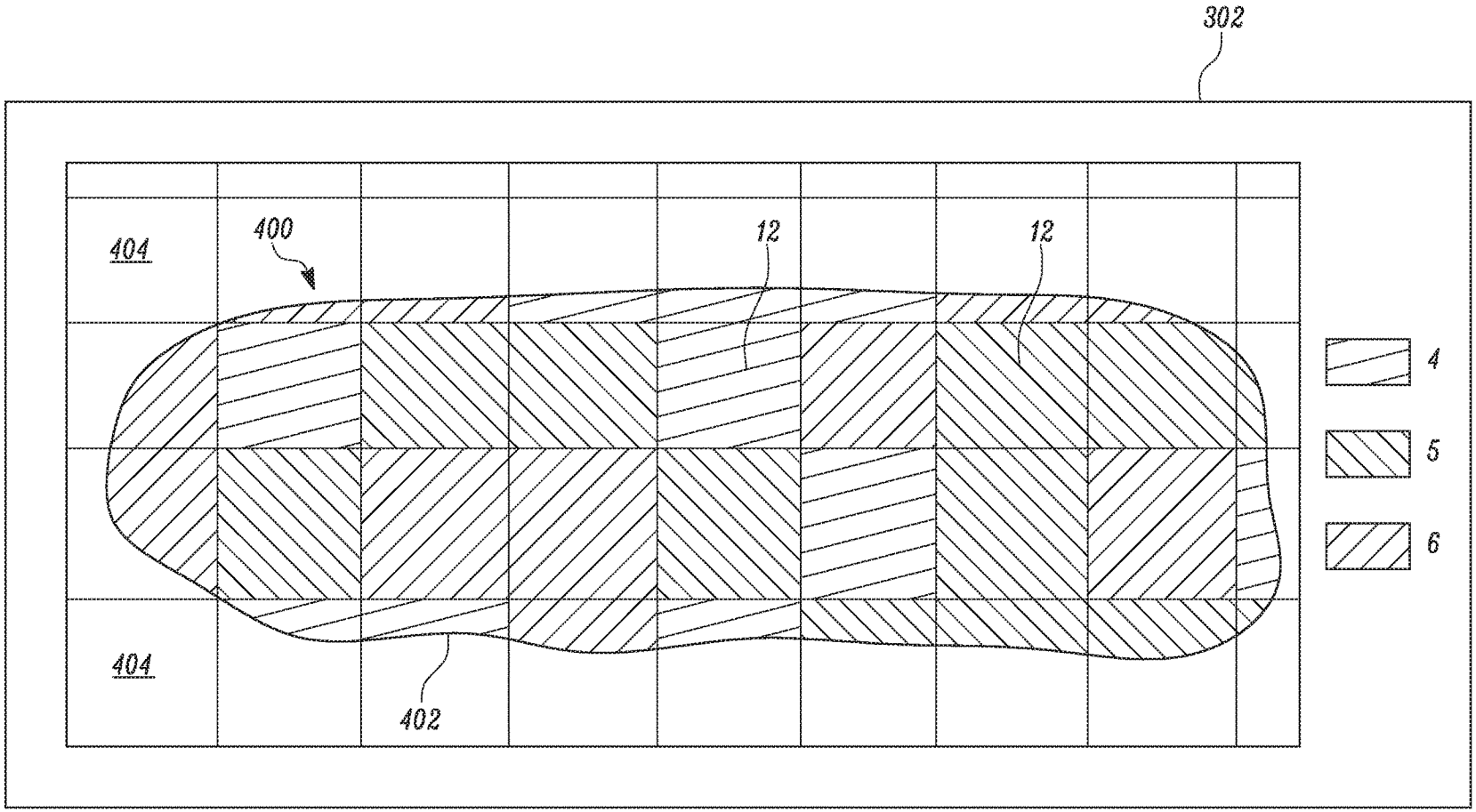
FIG. 4 illustrates a diagrammatic representation of a display device of the compactor of FIG. 1 showing a map, according to an exemplary embodiment of the present disclosure.

In some examples, the control system 126 may further include a terrain map of the worksite to be compacted. FIG. 4 illustrates a representation of the display device 302 showing an exemplary map 400 of the worksite 402 for the operator. The map 400 may be stored in the onboard memory, or some cloud server in communication with the control system 126 via conventionally known communication systems. As shown, the worksite 402 may be divided into a number of grids 404 of a desired resolution. In one example, each grid 404 may represent the work area 12. However, in other examples, the work area 12 may only be a portion of one grid 404 or spread to multiple grids 404. It may be understood that the shown size and shape of the grids 404 are exemplary only. The location sensor 200 may be configured to determine the location of the compactor 100 with respect to the work area 12 as the compactor 100 traverses the worksite 402. Further, the controller 210 may be configured to update each grid 404 or the work area 12, in the map 400, with the pass count 'N' information. In the illustration, the grids 404 are represented with different hatch patterns indicating the pass count 'N' for the respective grid 404 or the work area 12, in the map 400. The display device 302 may also show a scale or legends to relate the hatch pattern with the pass count 'N'. The information shown by the display device 302 may be used by the operator to visually inspect the compaction operation.

It may be contemplated that for at least certain compaction operations, where two or more compactors 100 are involved to complete the compaction operation over the work area 12; in such system 10, the control systems 126 of each of the two or more compactors 100 may be in sync with each other. Alternatively, all of the involved compactors 100 may have a common external control system 126 which is in communication with the variable vibratory mechanisms 120 of all of the involved compactors 100, in order to modify their compaction efforts to achieve the target compaction efforts 'V'. The second compactor (not shown) may have a second variable vibratory mechanism for providing a second compaction effort to the work area 12, and a second location sensor generating a second location data for the second compactor. The controller 210 is in communication with the second location sensor and the second variable vibratory mechanism, and configured to determine the pass count 'N' for the work area 12 based on the location data 'X' and the second location data.

Therefore, a first compactor 100 may traverse over the work area 12 with first amplitude and/or first frequency for one pass or set of passes. Then, a second compactor may traverse over the work area 12 with second amplitude and/or second frequency, for a subsequent pass or set of subsequent passes, and so on. It may be understood that one compactor 100 may complete multiple passes with same compaction effort and then a second compactor may be engaged to complete another round of multiple passes with different compaction effort. In such case, the control system 126 may also serve as an alternative or supplemental command center where the operator can monitor the progress of the compaction operation, view maps of the work area, etc.

INDUSTRIAL APPLICABILITY

The present disclosure finds potential application in, among other potential applications, any compaction operation which involves a compaction machine having a variable vibratory mechanism to provide a compaction effort. In particular, the present disclosure assists in minimizing decompaction and crushing of paving material, and further preventing damage to the compactor, from high compaction effort during the compaction operation. The present disclosure achieves this by determining a pass count of the compactor over a particular work area to be compacted, and thereby determining a target compaction effort for the variable vibratory mechanism to compact the paving material over that work area.

In a compaction operation, each pass made by the compactor over the work area changes the density of the paving material in that work area, and as the number of passes increases, the density of the paving material increases. Therefore, it would be more efficient to incrementally change the compaction effort, decrease the amplitude and/or increase the frequency of vibration of the compacting elements, each time a subsequent pass over the work area is initiated. Generally before the compaction operation starts, the contractors prepare a "test strip" where a short road is constructed, and results from this test strip provides the contractor with the information such as, the number of passes needed and required compaction effort for each pass, to attain the desired compaction of the paving material. For example, the contractor may decide that the compaction operation requires six passes with the first two passes to be performed at "high" compaction effort, the next two passes to be performed at "medium" compaction effort, and the last two passes to be performed at "low" compaction effort.

Conventionally, such compaction operation is completed by using two or more distinct compactors in series with successive compactors set at a reduced compaction effort. For example, three compactors may be used for above case, with the first compactor completing the first two passes at "high" compaction effort, the second compactor completing the next two passes at "medium" compaction effort, and the third compactor completing the last two passes at "low" compaction effort, as required. In some cases, the operator may utilize only one compactor with variable vibratory mechanism which could perform the passes, as required. However, such approaches are cumbersome as the operator (s) or the site manager needs to keep track of the number of passes that had been made over the same work area, and thus has the potential for human error. Errors, such as using a higher compaction effort than prescribed could result in crushing of the paving material, or a lower compaction effort than prescribed could lead to requiring more number of passes, and thus makes the overall job to be inefficient and inconsistent in quality.

Therefore, it would be advantageous to automate this function of modifying the compaction effort in consideration of the pass count without much human intervention. The control system 126 of the present disclosure takes into consideration the information about the pass count 'N', that is, the number of passes that has already been made by the compactor 100 over the same work area 12, and thereby determine the target compaction effort 'V' for the subsequent pass based on that information. The control system 126 is further capable to automatically modify the compaction effort to the target compaction effort 'V'. The present disclosure thereby assists in automating the compaction operation and leads to reduced labor costs and helping the contractors reduce potentially costly errors in the compaction operation. The present disclosure allows proactively altering the compaction effort of the compactor 100 for the work area 12, before the compactor 100 arrives at the work area 12, based on pass count 'N'.

While the present disclosure primarily uses the information about the pass count 'N' for determining the target compaction effort 'V' of the variable vibratory mechanism 120, in operation, many other characteristics and data parameters known to a person skilled in the art go into determining the compaction effort put out by the variable vibratory mechanism 120. The present disclosure contemplates the use of other factors such as the compaction data 'C', the temperature data 'T' and the moisture data 'M', in addition to the pass count 'N', for determining the compaction effort. In one example, if the control system 126 determines that the compactor 100 is performing the first pass, based on the pass count 'N', and the compaction data 'C' suggests that the paving material 14 is already substantially compacted; then the control system 126 may complete the pass with relatively lesser compaction effort in contrast to the compaction effort it would have used otherwise. In other example, if the control system 126 determines that the compactor 100 is performing the first pass, based on the pass count 'N', and the temperature data 'T' suggests that the paving material 14 is "hot", the control system 126 may complete the pass with high compaction effort. However, if the control system 126 determines that the compactor 100 is performing the first pass, based on the pass count 'N', and the temperature data 'T' suggests that the paving material 14 is "cold", the control system 126 may complete the pass with relatively lesser compaction effort as compared to the previous case.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

I claim:

1. A system for compacting a work area, comprising:

a compactor having a variable vibratory mechanism for providing a compaction effort to the work area;

a location sensor generating a location data for the compactor; and a controller in communication with the location sensor and the variable vibratory mechanism, and configured to:

determine a pass count for the work area based on the location data;

determine a target compaction effort provided by the variable vibratory mechanism of the compactor for the work area based on the pass count; and modify the compaction effort provided by the variable vibratory mechanism of the compactor to the target compaction effort.

2. The system of claim 1, wherein the target compaction effort corresponds to at least one of an amplitude value and a frequency value for the variable vibratory mechanism, and wherein the controller is configured to modify at least one of an amplitude and a frequency of the variable vibratory mechanism to match the amplitude value and the frequency value, respectively.

3. The system of claim 1 further comprising:

a second compactor having a second variable vibratory mechanism for providing a second compaction effort to the work area; and a second location sensor generating a second location data for the second compactor;

wherein the controller is further in communication with the second location sensor and the second variable vibratory mechanism, and configured to determine the pass count for the work area based on the location data and the second location data.

4. The system of claim 3, wherein the controller is further configured to modify the second compaction effort to the target compaction effort.

5. The system of claim 1 further comprising, a compaction sensor configured to generate a compaction data of the work area.

6. The system of claim 5, wherein the controller is in communication with the compaction sensor to receive the compaction data, and configured to modify the compaction effort based on the compaction data.

7. The system of claim 1 further comprising, a temperature sensor configured to generate a temperature data of the work area.

8. The system of claim 7, wherein the controller is in communication with the temperature sensor to receive the temperature data, and configured to modify the compaction effort based on the temperature data.

9. The system of claim 1 further comprising, a moisture sensor configured to generate a moisture data of the work area.

10. The system of claim 9, wherein the controller is in communication with the moisture sensor to receive the moisture data, and configured to modify the compaction effort based on the moisture data.

11. The system of claim 1 further comprising, a map of a worksite showing the pass count for the work area.

12. A method of operating a compactor having a variable vibratory mechanism for providing a compaction effort over a work area, comprising:

generating a location data for the compactor;

determining a pass count for the work area based on the location data;

determining a target compaction effort provided by the variable vibratory mechanism of the compactor for the work area based on the pass count; and modifying the compaction effort provided by the variable vibratory mechanism of the compactor to the target compaction effort.

13. The method of claim 12, wherein modifying the compaction effort to the target compaction effort comprises, modifying at least one of amplitude and frequency of the variable vibratory mechanism of the compactor to match an amplitude value and a frequency value, respectively, corresponding to the target compaction effort.

14. The method of claim 12 further comprising:

generating a second location data for a second compactor providing a second compaction effort;

determining the pass count for the work area based on the location data and the second location data; and modifying the second compaction effort to the target compaction effort.

15. The method of claim 14 further comprising, modifying the second compaction effort to the target compaction effort.

16. The method of claim 12 further comprising, modifying the compaction effort based on one or more of temperature and moisture of the work area.

17. A compactor, comprising:

a frame;

a compacting drum operably connected to the frame; and a variable vibratory mechanism coupled to the compacting drum and configured to provide a compaction effort to a work area;

a control system comprising:

a location sensor configured to generate a location data for the compactor; and a controller in communication with the location sensor and the variable vibratory mechanism, and configured to:

receive the location data;

determine a pass count for the work area based on the location data;

determine a target compaction effort provided by the variable vibratory mechanism of the compactor for the work area based on the pass count; and modify the compaction effort provided by the variable vibratory mechanism of the compactor to the target compaction effort.

18. The compactor of claim 17, wherein the target compaction effort corresponds to at least one of an amplitude value and a frequency value for the variable vibratory mechanism, and wherein the controller is configured to modify at least one of an amplitude and a frequency of the variable vibratory mechanism to match the amplitude value and the frequency value, respectively.

19. The compactor of claim 17, wherein the control system further comprises:

a display device configured to notify an operator of the compactor of the target compaction effort; and an input device configured to allow the operator to modify the compaction effort to the target compaction effort.

20. The compactor of claim 17, wherein the control system further comprises:

a compaction sensor configured to generate a compaction data of the work area;

a temperature sensor configured to generate a temperature data of the work area; and a moisture sensor configured to generate a moisture data of the work area;

wherein the controller is configured to modify the compaction effort based on one or more of the compaction data, temperature data and moisture data.

* * * * *